United States Patent [19]

Shin et al.

[11] Patent Number: 5,032,195

[45] Date of Patent: Jul. 16, 1991

[54] FE-BASE SHAPE MEMORY ALLOY

[75] Inventors: Myung Chul Shin; Kwang Koo Jee, both of Seoul, D.P.R. of Korea

[73] Assignee: Korea Institute of Science and Technology, Seoul, D.P.R. of Korea

[21] Appl. No.: 458,900

[22] Filed: Dec. 29, 1989

[30] Foreign Application Priority Data

Mar. 2, 1989 [KP] D.P.R. of Korea ..... 2571/1989

[51] Int. Cl.[5] ..... C22C 38/02; C22C 38/04

[52] U.S. Cl. ..... 148/402; 148/12 B; 148/12 R; 148/325; 148/327; 148/329

[58] Field of Search ..... 148/402, 325, 327, 329, 148/12 R, 12 B

[56] References Cited

FOREIGN PATENT DOCUMENTS 61-201761 9/1986 Japan .

OTHER PUBLICATIONS

CA108(22): 190604, 1986.

*Primary Examiner*—R. Dean
*Assistant Examiner*—Margery S. Phipps
*Attorney, Agent, or Firm*—Darby & Darby

[57] ABSTRACT

A Fe-base shape memory alloy consisting of 15–20 wt. % of Mn, not more than 3 wt. % of Si, not more than 10 wt. % of Cr, and the balance being Fe and inevitable impurities is cold worked and heated to 400°–700° C. The Fe-base shape memory alloy of the present invention can be manufactured at low prices by reducing or avoiding the use of high priced elements compared to existing Ti-Ni alloy, and is superior to existing Fe-base shape memory alloy in the shape memory capacity and cold workability.

3 Claims, No Drawings

FE-BASE SHAPE MEMORY ALLOY

BACKGROUND OF THE INVENTION

The present invention relates to an alloy of Fe-Mn-Si-Cr, and more particularly to a Fe-base shape memory alloy which has good cold worbability and exhibits an improved shape memory effect by a structure hardening through a heat treatment.

Generally, the shape memory alloy has the properties to return to its original shape with a transformation when it is heated over its critical temperature after deforming its shape at low temperature. Accordingly, the shape memory alloy is utilized in various industrial fields such as piping joints for hydraulic equipments, robots, thermo control elements and the like.

As a typical shape memory alloy, a Ni-Ti shape memory alloy may be given which is in practical use. The Ni-Ti shape memory alloy has the good mechanical properties such as elongation rate, yield strength, tensile strength, toughness and the like, while the elements of Ni and Ti not only have high price but also require vacuum melting in manufacturing. In addition, the Ni-Ti shape memory has also a problem of not being used in various fields since the room temperature working such as mechanical working and elongation are difficult.

It has, therefore, been developed a copper-base shape memory alloy which is available with low cost, to substitute the Ni-Ti shape memory alloy, but it is inferior to existing Ni-Ti shape memory alloy in its mechanical properties such as strength and elongation rate, and the thermal stability. It has also problems of low elongation and aging effect due to the grain being coarse.

Japanese Patent Publication No. Sho 61-201761 discloses a Fe-base shape memory consisting of 20–40% of Mn, 3.5–8% of Si and small quantities of Cr, Ni, Co, Mo, C, Al, Cu and the balance being Fe. The above mentioned Fe-Mn-Si base alloy is known that it exhibits an improved shape memory effect by a small quantity of additives and its manufacturing process is simple and it also exhibits good strength and toughness.

Moreover, the highest applied temperature of this Fe-base shape memory is 300° C. while that of the conventional Ti-Ni shape memory alloy is about 150° C., therefore it exhibits a good thermal stability in practical use.

Particularly, it is known that the Fe-Mn-Si alloy exhibits the best shape memory effect in the range of 30–32% of Mn and 6% of Si. However, in such a composition rate the cold working is almost impossible on account of the excess Si, thereby giving rise to some problems that manufacturing of plate or wire is difficult and the work hardening required to improve the shape memory effect is not obtained.

SUMMARY OF THE INVENTION

Therefore, the object of the present invention is to provide a Fe-base shape memory alloy which exhibits good cold workability and shape memory effect.

The Fe-base shape memory alloy of the present invention consists of a small quantity of Si and Cr in addition to the basic elements of Fe-Mn. To improve the cold workability, the element of Si which impairs the cold workability is reduced and Cr is added to enhance the cold workability, at the same time promoting the production of subgrain by carrying out a heat treatment at 400°–700° C. after a cold working to obtain a hardened structure. Since the hardened structure prevents the shifting of dislocation during its deformation, allowing the deformation to occur only by the phase transformation of $\epsilon \rightarrow \gamma$, thereby improving the shape memory effect.

DETAILED DESCRIPTION OF THE INVENTION

The Fe-base shape memory alloy of the present invention consists of 15–20wt % of Mn, not more than 3wt % of Si, not more than 10wt % of Cr, and the balance being Fe and inevitable impurities.

As for the elements, Mn is known as an austenite stabilizing element and in case that the content exceeds 15% $\epsilon$-phase is introduced by the stress. While the content of Mn exceeds 20% the shape memory effect is deteriorated.

Si is an element for facilitating the phase transformation of $\gamma \rightarrow \epsilon$ and for enhancing the shape memory effect. However, when the content of Si exceeds 3% it forms an intermetallic compound such as $Fe_3Si$ in the structure and accordingly it impairs the cold workability. Therefore, the content should not exceed 3%.

Cr renders the phase transformation of $\gamma \rightarrow \epsilon$ made easy and the cold workability and the corrosion resistance to be enhanced, whereas it has a bad effect on the shape memory effect. Particularly, in case that the content exceeds 10% it impairs the high temperature workability, so that the content should be maintained not more than 10%.

The present invention will now be described in detail with reference to the following example.

EXAMPLE

Alloys of different composition were melted in vaccuo in a high frequency induction furnace to manufacture ingots and after homogenizing at 950° C. for 2 hours they were hot rolled in the thickness of 0.8mm and 4mm.

The rolled plate of 4mm was annealed at room temperature several times and then cold rolled into a plate having 0.8mm in thickness. Both the hot rolled plate and cold rolled plate were cut into test pieces having the size of 0.8 ×3.0 ×60mm, and the cold rolled plate was annealed at 600° C. for 2 hours.

Table 1 shows the shape memory capacity according to the change of the content of Mn, wherein the test pieces were deformed in their shapes by 45° and then heated over the austenite transformation finish temperature (Af), thereafter the recovering angles were measured.

TABLE 1

| | Elements | | |
|---|---|---|---|
| | Mn (%) | Fe | Shape Memory Capacity (%) |
| Alloy | 20 | bal. | 61 |
| | 25 | bal. | 31 |
| | 30 | bal. | 13 |
| | 35 | bal. | 7 |

As can be noted from Table 1, the shape memory capacity was conspicuously decreased when the content of Mn exceeds 20%.

Next, to examine the change of the shape memory capacity depending upon the addition of Si and Cr cold rolled plate and hot rolled plate test pieces were deformed in their shapes by 90° and then heated over the austenite transformation finish temperature(Af), thereafter the recovering angles were measured, Where, the alloy of the present invention is a test piece that was annealed at 600° C. for 2 hours after cold rolling, and the comparative alloy is a test piece that was hot worked.

TABLE 2

| | Elements | | | | |
|---|---|---|---|---|---|
| | Mn (%) | Si (%) | Cr (%) | Fe | Shape Memory Capacity (%) |
| Alloy of the Present Invention | 20 | 3 | 0 | bal. | 73 |
| | 20 | 3 | 5 | bal. | 82 |
| Comparative Alloy | 30 | 6 | 0 | bal. | 70 |
| | 20 | 3 | 0 | bal. | 52 |
| | 20 | 3 | 5 | bal. | 12 |

As can be noted from Table 2, the shape memory capacity of the alloy of the present invention which was cold worked is superior to that of the comparative alloy which was hot worked in its shape memory capacity. On the other hand, the cold workability was measured with respect to the respective test pieces which had been hot worked, and the results are shown in Table. 3.

TABLE 3

| | Elements | | | | |
|---|---|---|---|---|---|
| | Mn (%) | Si (%) | Cr (%) | Fe | Reduction of Area (%) |
| Alloy of the Present | 20 | 3 | 0 | bal. | 26 |
| | 20 | 3 | 5 | bal. | 35 |

TABLE 3-continued

| | Elements | | | | |
|---|---|---|---|---|---|
| | Mn (%) | Si (%) | Cr (%) | Fe | Reduction of Area (%) |
| Invention Comparative Alloy | 30 | 6 | 0 | bal. | 8 |

As can be seen from Table 3, in case that Cr is contained the reduction of area is considerably large and as a result, the hardness was enhanced by the cold working.

As described above in detail, the Fe-base shape memory alloy of the present invention is manufactured at low prices by avoiding or reducing use of high priced elements compared to conventional Ti-Ni alloy, and has the advantages that since it has good shape memory capacity compared to the conventional Fe-base memory and is cold workable, thin plate or wire is possible to be easily manufactured.

What is claimed is:

1. An Fe-base shape memory alloy produced by cold working an alloy consisting essentially of between 15 and 20% by weight of manganese, up to 3% by weight of silicon, up to 10% by weight of chromium and the balance being iron and associated impurities, and treating said cold worked alloy at a temperature of between 400° and 700° C. after said cold working step.

2. The Fe-base shape memory alloy of claim 1 wherein said cold working step comprises cold rolling.

3. The shape memory alloy of claim 1 consisting essentially of 20% by weight manganese, 3% by weight silicon, 5% by weight chromium and the balance iron and associated impurities.

* * * * *